US010506843B2

(12) United States Patent
Clough

(10) Patent No.: US 10,506,843 B2
(45) Date of Patent: Dec. 17, 2019

(54) ORTHOPEDIC SHOE APPLIANCE

(71) Applicant: Cluffy, LLC, Polson, MT (US)

(72) Inventor: James G. Clough, Polson, MT (US)

(73) Assignee: Cluffy, LLC, Polson, MT (US)

( * ) Notice: Subject to any disclaimer, the term of this patent is extended or adjusted under 35 U.S.C. 154(b) by 91 days.

(21) Appl. No.: 14/862,757

(22) Filed: Sep. 23, 2015

(65) Prior Publication Data

US 2017/0079371 A1 Mar. 23, 2017

(51) Int. Cl.
*A43B 7/14* (2006.01)
*A43B 17/00* (2006.01)

(52) U.S. Cl.
CPC ..... *A43B 7/143* (2013.01); *A43B 7/142* (2013.01); *A43B 7/149* (2013.01); *A43B 7/1445* (2013.01); *A43B 17/00* (2013.01)

(58) Field of Classification Search
CPC ..... A43B 7/14; A43B 7/1405; A43B 7/141; A43B 7/142; A43B 7/143; A43B 7/1445; A43B 7/149; A43B 17/00
USPC ..... 36/71, 91, 140, 145, 166
See application file for complete search history.

(56) References Cited

U.S. PATENT DOCUMENTS 1,845,681 A * 2/1932 Read ..... A43B 7/06 36/147
2,089,384 A * 8/1937 Levitt ..... A43B 7/1445 36/145
2,161,565 A * 6/1939 Freda ..... A43B 7/14 36/180
3,265,071 A * 8/1966 Kirchner ..... A43B 7/142 36/145
4,224,750 A 9/1980 Delport
4,333,472 A 6/1982 Tager
4,813,159 A 3/1989 Weiss
5,388,351 A * 2/1995 Mitchell ..... A43B 7/142 36/145
6,141,890 A * 11/2000 Chtn ..... A43B 3/12 36/141
6,725,578 B2 * 4/2004 Kerrigan ..... A43B 7/142 36/144
8,240,066 B2 * 8/2012 Logan ..... A61F 5/0111 36/145
9,439,810 B2 * 9/2016 Stilwell ..... A61F 13/064
2006/0242860 A1 11/2006 Canvin
2010/0263232 A1 * 10/2010 Smirman ..... A43B 5/1641 36/43
2011/0099842 A1 * 5/2011 Burke ..... A43B 7/142 36/44

* cited by examiner

*Primary Examiner* — Sharon M Prange
(74) *Attorney, Agent, or Firm* — Osha Liang LLP

(57) ABSTRACT

An orthopedic shoe appliance includes a pad for providing support for midfoot arches, the second metatarsal, and the third metatarsal of a foot, wherein the pad does not provide substantial support under a heel of the foot or under the first metatarsal, the fourth metatarsal, and the fifth metatarsal. A method for manufacturing an orthopedic appliance includes obtaining a pad; and shaping the pad to provide support for midfoot arches, the second metatarsal, and the third metatarsal of a foot, but not provide substantial support under a heel of the foot or under the first metatarsal, the fourth metatarsal, and the fifth metatarsal.

10 Claims, 3 Drawing Sheets

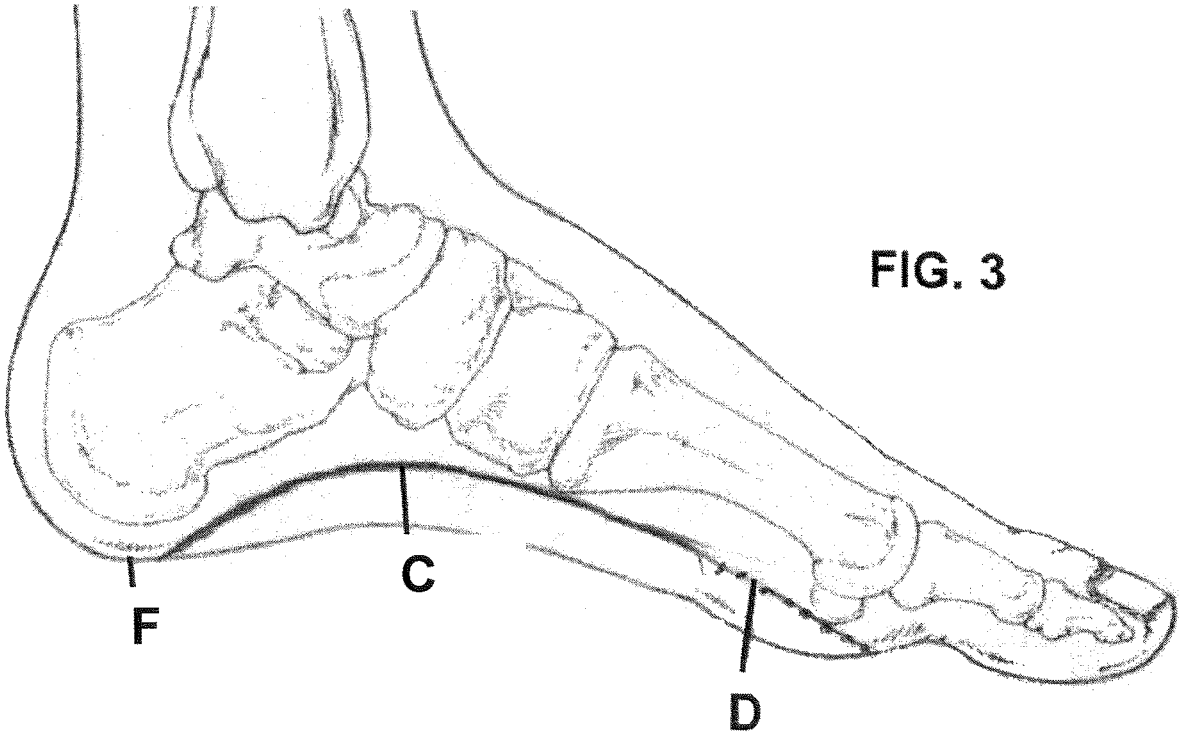
FIG. 3
FIG. 4
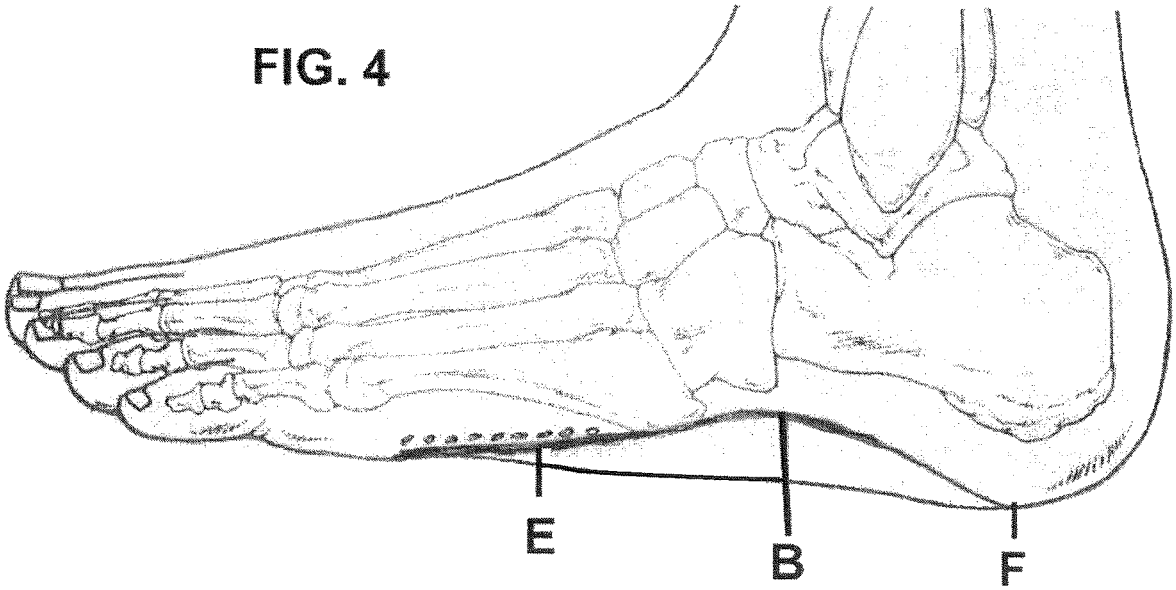

ORTHOPEDIC SHOE APPLIANCE

BACKGROUND OF INVENTION

Field of the Invention

The present invention relates to orthopedic shoe appliances specifically adapted to supporting those segments of the foot requiring stability and allowing other segments to move freely that are meant to move as the foot moves through its phases of gait.

Description of Related Art

When a person ambulates, the foot is required to serve two essential roles. As the heel contact the ground, the foot functions as a mobile adapter to the terrain and as a shock absorber. This is commonly referred to as pronation. As the foot moves forward, the big toe moves upward, in coordination with the forward movement of the opposite arm, to help the foot to become much more stable through the windlass mechanism that causes the bone structure to assume a much more closely packed position, thereby enhancing the stability of the foot. This is commonly referred to as supination. This change of the foot bone structure is necessary as the foot serves two essentially opposite roles in the course of ambulation.

Improper foot structure may cause pain in the foot or inefficient ambulation. To correct such defects and alleviate pains, many orthopedic devices (orthopedic appliances) have been developed. These orthopedic appliances may be designed to correct specific types of foot problems.

For example, U.S. Pat. No. 4,813,159, issued to Weiss, discloses an insole having an extension under the first and fifth toes and a heel post to correct for an inverted heel. The device provides for added correction in these areas to control malposition of the foot.

U.S. Pat. No. 4,224,750, issued to Delport, discloses an insole applied to footwear that has various support features and goes from the heel to the metatarsals. It supports the entire foot and does not contain any areas where there is no material under the foot from the metatarsals to the heel.

U.S. Pat. No. 4,333,472, issued to Tager, discloses a compensatory corrective orthopedic foot device comprising a series of differentially sized, geometrically shaped, and specifically configured, generally wedge-shaped prosthetic devices that are used in compensatory treatments of specific clinical structural abnormalities of a human foot.

U.S. Patent Application Publication No. 2006/0242860, by Canvin, discloses an insole as part of a footwear that comprises a metatarsal insert and a combined heel and arch insert. This is a full length insole with different materials having differing durometers to accommodate different support areas targeted by this insole.

While the above identified prior art devices are useful for correcting various foot problems, there is still a need for orthopedic appliances that can provide further correction of foot defects

SUMMARY OF THE INVENTION

Embodiments of the present invention relate to orthopedic appliances (or orthopedic shoe appliances) and methods for manufacturing the orthopedic appliances. Orthopedic appliances of the invention may provide improved functions of the human foot, by selectively stabilizing certain segments (areas) of a foot, while allowing other segments (areas) of a foot to move freely. This selective stabilization may be accomplished by having an orthopedic appliance for placement under the foot in the selected areas. The orthopedic appliances may have different heights and/or different material properties (e.g., durometers) at different locations. In addition, orthopedic appliances of the invention are designed to have no support in areas (e.g., under the heel) that need more free movements, in order to promote normal gait and better interface with footwear.

In accordance with embodiments of the invention, the unique combination of having supports in selected areas and lacking support in other areas leads to physiologic promotion of more normal motion in certain locations of the foot, such as the first, fourth, and fifth rays, while restricting unnecessary motion in other areas, such as the mid-foot and midtarsal joints and, therefore, the subtalar joint. The unique combination of having supports under selected areas of a foot and lacking supports under other areas of a foot, achieve a synergistic effect in the effectiveness of correcting abnormal foot function.

The physiologic and unique characteristics of an orthopedic appliance of the invention may be designed with footwear in mind. It may be designed to complement or enhance integration of the current devices with footwear, for optimal foot control and reduction of physical symptoms associated with ambulatory mechanical disorders. There are many deformities and pains that may be prevented by the use of a product of the present invention, including bunion, hammertoes, neuromas bunionettes, Achilles tendon disorders, postural pains, heel pain, metatarsal pain, stress fracture, arch fatigue and tendonitis, when used in conjunction with a program of promoting normal gait.

An orthopedic appliance of the invention can be used with a foot, inserted into a sock or use with footwear (e.g., a shoe or sandal). Alternatively, an orthopedic appliance of the invention may be built into an insole, a midsole or an outsole of a shoe or other footwear. That is, an orthopedic appliance of the invention may be formed as an integral piece with an insole, a midsole, an outsole, or a footwear. Such an orthopedic appliance may be made of any suitable material commonly used for such purposes, such as a gel material, foam, thermoplastics, leather, cork, fiber, or various combinations of materials.

An orthopedic appliance of the invention can provide support for the midfoot arches (i.e., the lateral longitudinal arch, the medial longitudinal arch, and the transverse metatarsal arch), while it provides no support under the heel and/or the distal ends of the first, fourth, and fifth metatarsals.

In accordance with some embodiments of the invention, an orthopedic appliance of the invention may comprise a substantially triangular-shaped piece to provide midfoot arch supports (i.e., the medial longitudinal arch support, the lateral longitudinal arch support, and the transverse metatarsal arch support). Such an orthopedic appliance may be of varying heights to support selected segments of the foot needing more stability in the select areas, while motion is promoted in other areas that need to move freely for normal foot function.

In accordance with some embodiments of the invention, an orthopedic appliance may be disposed in footwear and is to be worn for improved function of the foot structures during ambulation. An orthopedic appliance of the invention may be attached to an insole, midsole or outsole by any means known in the art. For example, an orthopedic appliance of the invention may be attached to an insole, midsole, or outsole via Velcro® (i.e., a loop-and-hook mechanism), adhesive, glue, a strap, etc. In addition, an insole, midsole, or outsole may be provided with holes and an orthopedic appliance of the invention may be provided with matching pegs (protrusions) and an orthopedic appliance of the invention may be provided with matching holes that can accommodate the matching pegs.

Alternatively, an orthopedic appliance of the invention may be formed as an integral piece of an insole, a midsole, an outsole, or a footwear (e.g., a shoe, a sandal, etc.). Alternatively, such an orthopedic appliance may be used with a sock, either by attaching to inside or outside of a sock, or be integrated with a sock.

In accordance with some embodiments of the present invention, an orthopedic appliance may be applied to a human foot. For example, such an orthopedic appliance may include a mechanism (e.g., a strap, an elastic band, Velcro, etc.) for attachment to the foot.

A method in accordance with embodiments of the invention may comprise using an orthopedic appliance of the invention, such as a substantially triangular-shaped piece described above, to support the segments of the foot needing more stability in select areas of the foot. At the same time, motion is promoted in other segments that need to move freely for normal foot function. To promote movements in such areas, an orthopedic appliance of the invention may be designed to have no material in these areas (e.g., under the heel or first, fourth, and fifth metatarsals) such that more normal physiologic foot function can occur.

In accordance with some embodiments of the invention, a method for manufacturing an orthopedic appliance, comprising: providing a pad; and shaping the pad to provide support for midfoot arches, the second metatarsal, and the third metatarsal of a foot, but not under a heel of the foot or under the first metatarsal, the fourth metatarsal, and the fifth metatarsal.

In accordance with embodiments of the present invention, an orthopedic appliance is easy to manufacture and of sturdy construction to allow for long-term use.

In accordance with embodiments of the present invention, an orthopedic shoe appliance may allow for a combination of stability in certain areas and freedom of motion in other areas in a unique and optimal physiologic manner.

Embodiments of the invention are achieved by orthopedic shoe appliances and methods specifically designed to provide for improved functions of the foot structure during ambulation.

Further aspects of the present invention will become apparent from the following description references being had to the accompanying drawings wherein a preferred form of the embodiment of the current invention is clearly shown.

BRIEF DESCRIPTION OF THE DRAWINGS

FIG. 3 shows a side view of the medial side of a foot showing the contour of an orthopedic appliance of the invention fit to the medial arch of the foot.

FIG. 4 shows a side view of the lateral side of a foot illustrating the contour of an orthopedic appliance of the invention fit to the lateral arch of the foot.

DETAILED DESCRIPTION

Embodiments of the invention relate to orthopedic appliances that have supports under selected locations of a foot, while lack of supports under other areas of the foot. Some embodiments of the invention relate to methods for supporting a foot using an orthopedic appliance of the invention such that certain areas of a foot is provided with supports, while other areas lack supports, during ambulation.

Figure 1:
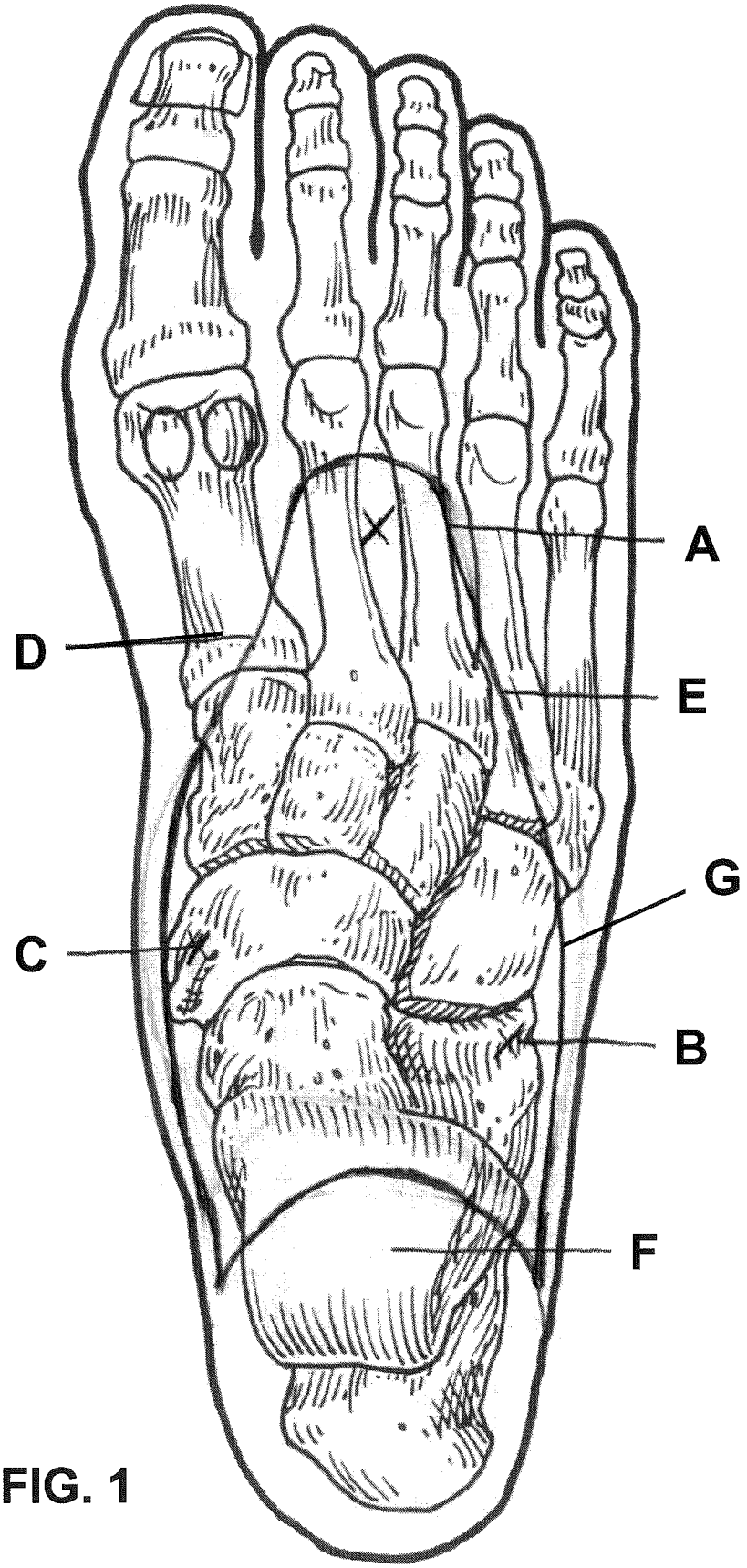
FIG. 1 shows an illustration of an orthopedic appliance in accordance with an embodiment of the invention showing the locations where the orthopedic appliance sits in relation to the bone structure of a human foot.

As used herein, the terms "orthopedic appliance" and "orthopedic shoe appliance" may be used interchangeably and each refers to a pad (or a device) having different heights and/or durometers in different regions of the pad to provide different extents of support to a foot. In accordance with embodiments of the invention, an orthopedic appliance may also be designed to be devoid of support (or no substantial support) under certain areas (e.g., the first, fourth, and fifth metatarsals) of a foot. As used herein, "no substantial support" under certain areas means that the pad does not reach under certain areas or only reaches under these areas slightly. For examples, a pad that does not provide substantial support to the first, fourth, and fifth metatarsals may reach under a portion of the proximate ends of these metatarsals, but would not reach under the middle or distal ends of these metatarsals, as illustrated in FIG. 1.

Such an orthopedic appliance may be used under a foot to support selected areas of the bone structures of a foot, while not providing substantial support under other areas of the foot to allow these other areas to flex more. Furthermore, the support at the selected areas will function as a cantilever to further facilitate movements of these other areas that are not supported, thereby achieving synergistic effects.

As used herein, the term "midfoot arches" refers to the medial longitudinal arch, the lateral longitudinal arch, and the transverse metatarsal arch. As used herein, the term "footwear" refers to a shoe, a sandal, a slipper, a boot, or the like.

Materials for use with embodiments of the invention may include any suitable materials known in the art for making footwear or footwear accessories. Such materials, for example, may include plastic, rubber, elastomer, foam, cork, wood, metal, alloy, fiber etc. or a combination thereof. An orthopedic appliance of the invention may use different heights in different regions and/or different durometers (e.g., different materials) in different regions to provide different extents of support in different areas under a foot. In addition, a proper height or durometer in a particular region may be designed based on an average foot of certain sizes or may be designed for a particular individual (i.e., custom fit). Based on teachings in this disclosure and common knowledge known in the art, one skilled in the art would be able to design and manufacture such orthopedic appliances without undue experimentation.

Embodiments of the invention are based on the observation that there are joints of the foot that serve as stabilizers, where little motion occurs. On the other hand, there are other segments that undergo more significant changes (mobile adapters), depending on the positions of the foot in the instep of the foot, commonly referred to as Lisfrancs' joint in the medical literature.

For example, the first metatarsal cuneiform joint is a relatively mobile segment allowing the first metatarsal to move upward as the foot contacts the floor and move downward as the big toe moves upward. In contrast, the second and third metatarsal cuneiform joints are very stable due to the shape of the bone and the strong ligamentous structure. These are not meant to move that much and, therefore, do provide inherent stability to the foot structure.

The fourth and fifth metatarsal cuboid joints are mobile adapters and serve to cushion the strike of the forefoot on the ground, particularly with certain athletic activities, in which the outside of the foot contacts the ground initially.

Providing support to the midfoot arches also allows for a better control of excessive deleterious motion of the metatarsals 1, 4, and 5 upward. The supports for the midfoot arches can be accomplished medially with a medial longitudinal arch support and laterally with a lateral longitudinal arch support. In addition, support can be provided to the transmetatarsal arch. The principle of support in the mid foot location is to cantilever the metatarsal heads downward by applying an upward force on the base (proximal end) of the metatarsals, thereby preventing excessive upward movements of the distal ends of the metatarsals.

Accordingly, orthopedic appliances of the invention are designed to support the midfoot arches and under the second and third metatarsals. However, these orthopedic appliances preferably would not have substantial supports under the first, fourth, and fifth metatarsals, at least not supporting the distal ends of the first, fourth, and fifth metatarsals. In accordance with some embodiments, orthopedic appliances of the invention may reach a small parts of the proximal ends of the first, fourth and fifth metatarsals, but not to the middle or distal ends of these metatarsals.

The heel of a foot is not easily controlled by placing a material under or around the heel, and any such control may result in problems with poor fit in most footwear and result in reduced comfort in many individuals.

Orthopedic appliances of the present invention substantially do not have support materials under the first, fourth and fifth metatarsals to allow these segments to move downward, but have support materials under the medial lateral and transverse metatarsal arches to provide supports for these arches. Supporting the midfoot arches actually allows for control of the excessive deleterious upward motions of metatarsals 1, 4, and 5. The midfoot support can be accomplished medially with a medial longitudinal arch support and laterally with a lateral longitudinal arch support. The principle of supports at these locations is to cantilever the metatarsal heads downward by applying an upward force on the base of the metatarsals. In addition, an orthopedic appliance of the invention also provides support under the second and third metatarsals. The second and third metatarsals are not involved in significant movements during ambulation. Therefore, support under the second and third metatarsals would increase the stability of a foot. Furthermore, in accordance with embodiments of the invention, an orthopedic appliance has is no support material under the heel to allow for better comfort and fit of the orthopedic appliance in footwear.

Conventional orthopedic corrective devices for controlling excessive pronation and supination do not allow the mobile metatarsal segments 1, 4 and 5, to move downward because the support materials are applied under these bones distally (i.e., under the distal ends of the metatarsals). This is a hindrance to normal foot functions and can result in a non-physiologic and restricted motion of the foot structure. Removal of material under the heel allows better comfort and fit of the device in footwear, while promoting better rocking of the foot forward during the step.

The present invention relates specifically to orthopedic corrective devices that may be disposed in a footwear and applied to the correction and treatment of ambulatory mechanical disorders and ensuing physical symptoms.

Embodiments of the invention will be further explained with references to the accompanied drawings. The specific examples described are for illustration only. One skilled in the art would appreciate that other modifications and variations from these specific examples are possible without departing from the scope of the invention.

Referring to FIG. 1, which shows an orthopedic shoe appliance (G) applied over a diagram of the skeleton of the human foot. Point (A) shows the distal aspect of the orthopedic appliance proximal to the second and third metatarsals, and with a raise in this area under the transverse metatarsal arch. Point (B) is located at the lateral longitudinal arch, of which the highest point is at the calcaneal-cuboid joint. Point (C) is located at the highest point of the medial longitudinal arch around the point of the tarsal navicular bone.

Point (D) shows the first metatarsal is not substantially supported by the orthopedic appliance (G)—i.e., the orthopedic appliance does not reach under the center and distal portion of the first metatarsal. This is to allow the first metatarsal to plantarflex during propulsion in the normal gait cycle as the hallux dorsiflexes. The Point (C) acts as a cantilever to plantarflex metatarsal 1. This eliminates any deformity of the forefoot referred to as forefoot supination or forefoot varus. Any material under the first metatarsal may potentially limit the ability of the first metatarsal to plantarflex. Therefore, an orthopedic appliance of the invention is designed to have no support material under the first metatarsal.

Point (E) shows that the orthopedic appliance (G) substantially does not go under the fourth and fifth metatarsals to allow these bones to plantarflex in propulsion, so that point (B) may act to cantilever the fourth and fifth metatarsals in a downward manner. This eliminates any deformity referred to as forefoot valgus.

In addition, Point (F) shows that the orthopedic appliance (G) does not go under the heel. This is to allow the heel to sit in the shoe for a better fit and comfort. Control of the heel is facilitated by point (B) to support the calcaneus in an elevated position and point (C) to support the talar head and medial longitudinal arch.

Figure 2:
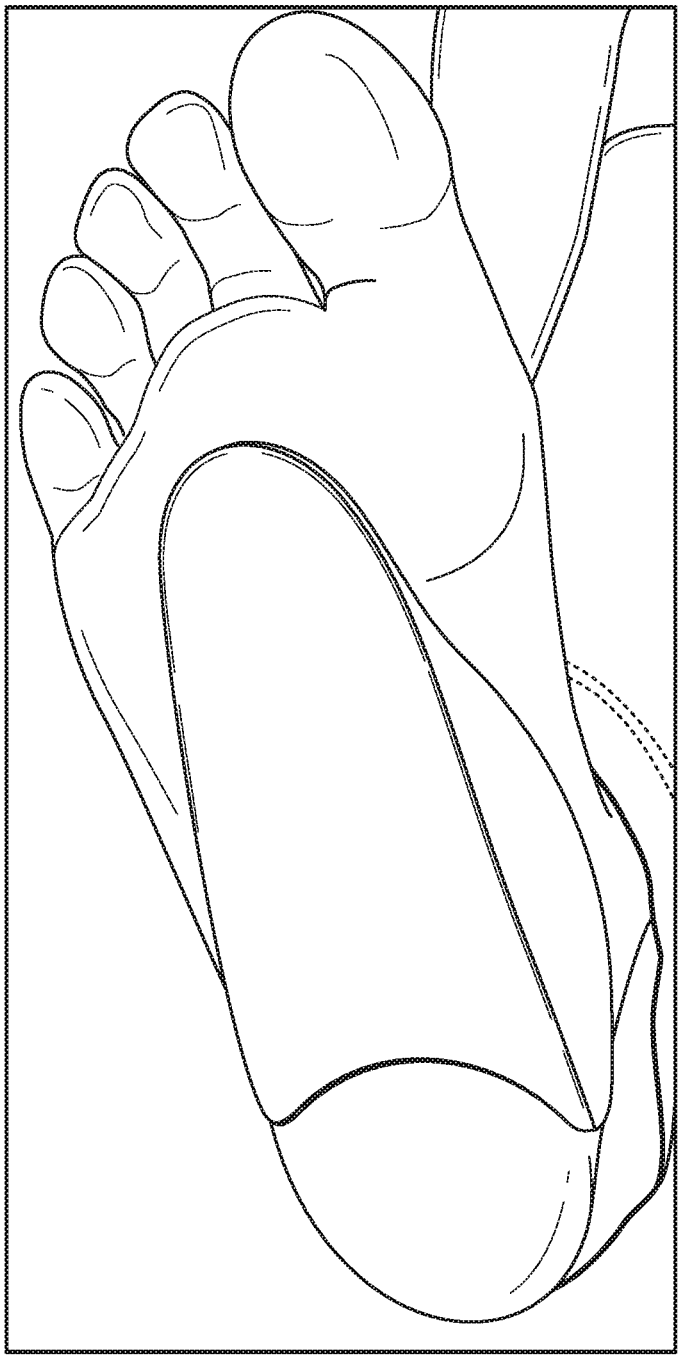
FIG. 2 shows an illustration of an orthopedic appliance in accordance with an embodiment of the invention showing the locations where the orthopedic appliance sits in relation to the form of a human foot.

Therefore, an orthopedic appliance of the invention is designed to have no support material under the first metatarsal, the fourth metatarsal and the fifth metatarsal, as well as no support under the heel. However, orthopedic appliances of the invention are designed to have support materials under the second and the third metatarsals, as well as under the midfoot arches, as shown in FIG. 2, which shows a perspective view of an orthopedic appliance in accordance with one embodiment of the invention placed on a foot.

FIG. 3 shows a side view of the medial aspect of a human foot. Point (F) shows that an orthopedic appliance of the invention does not go under the heel of the foot. Point (C) shows that the height of the arch on the medial side of the device is located at the tarsal navicular bone. Point (D) (dotted line) shows that an orthopedic appliance of the invention substantially does not extend under the first metatarsal (not under the distal end of the first metatarsal; see FIG. 1), but extends under the second and third metatarsals.

FIG. 4 shows a lateral perspective of a human foot. Point (F) shows that an orthopedic appliance of the invention does not extend under the heel of the foot. Point (B) shows the highest point of the lateral arch is at the calcaneal-cuboid joint. Point (E) (dotted line) shows that an orthopedic appliance of the invention substantially does not extend under the fourth and fifth metatarsals (i.e., does not reach under the distal ends of the fourth and fifth metatarsals; see FIG. 1). However, an orthopedic appliance of the invention does extend under the second and third metatarsals (see FIG. 1).

In accordance with embodiments of the invention, lack of support under the first metatarsal, fourth metatarsal, and fifth metatarsal, coupled with support under midfoot arches (e.g., points (B) and (C) shown in FIG. 3 and FIG. 4), provides proper support to a foot and permits the metatarsals to have downward movement to correct for any forefoot supination or forefoot valgus. These combined features are unique for the orthopedic appliances of the invention. It is also noteworthy that the lack of material under the heel is unique and allows for better comfort for the user and better fit in footwear. It has been found that materials under the heel are ineffective at controlling pronation and supination of the heel. In accordance with embodiments of the invention, the lack of materials under the heel allows the heel to function as intended, i.e., to roll forward for the next step.

Embodiments of the invention may have one or more of the following advantages. Orthopedic appliances of the invention are designed to support selected areas under a foot, instead of supporting all areas of the foot because not all areas under the foot need equal amounts of support. The selected areas for support include midfoot arches and under the second and third metatarsals. These segments in a bone structure of a foot move less during ambulation and would benefit from more support. Limiting motion in these segments would promote, via cantilever action, motions in other joints that require more movement during ambulation.

In a bone structure of a foot, certain segments are required to be more mobile than others during ambulation. These mobile segments require more freedom to move and therefore would benefit from less support (relative to other areas) for normal functions of a foot. Therefore, orthopedic appliances of the invention may be specifically designed to be devoid of support under these segments.

Providing support under segments that require less movement can also function as a cantilever to facilitate segments that need to move more. Therefore, a combination of providing support under the selected regions and not providing support under other regions can achieve synergistic effects, allowing more effective correction of any ambulatory problems of a foot.

The orthopedic appliances of the invention may be attached to an insole, midsole, or outsole of a shoe. Alternatively, these orthopedic appliances may be designed to be an integral part of an insole, midsole, outsole, or a footwear. In addition, these orthopedic appliances may be attached to inside or outside of a sock, or formed as an integral part of a sock. These orthopedic appliances may be used together with other orthopedic devices, such as an Cluffy Wedge®, as disclosed in U.S. Pat. Nos. 6,170,176, 6,874,258, and 6,938,363, issued to the inventor of the present invention.

While the invention has been described with a limited number of examples, those skilled in the art, having the benefit of this disclosure, would appreciate that other modifications and variations are possible without departing from the scope of the invention. Accordingly, the scope of the invention should be limited only by the attached claims.

What is claimed is:

1. An orthopedic shoe appliance, comprising:

a pad for providing support for midfoot arches, the second metatarsal, and the third metatarsal of a foot, wherein the pad is configured to not provide support under a heel of the foot, wherein the pad comprises a first portion configured to provide support to the midfoot arches, and a second portion that extends distally from a region corresponding to proximal ends of the second and third metatarsals to form an elongate extension that supports the second and third metatarsals and such that the distal end of the pad is configured to not reach a middle of the first metatarsal, the fourth metatarsal, and the fifth metatarsal, wherein the first portion comprises a medial raised contour configured to be disposed under a medial arch and a lateral raised contour configured to be disposed under a lateral portion of the foot and the cuboid, and wherein a width of the second portion is smaller than a width of the first portion, the distal end is narrower than a proximal end of the orthopedic shoe appliance, and the second portion, moving away from the distal end, widens generally continuously to reach the lateral raised contour.

2. The orthopedic shoe appliance of claim 1, wherein the pad is attached to an insole, a midsole, an outsole, or a sock.

3. The orthopedic shoe appliance of claim 2, wherein the pad is integrally formed with the insole, the midsole, the outsole, or the sock as a unitary piece.

4. The orthopedic shoe appliance of claim 1, wherein the pad is attached to a footwear.

5. The orthopedic shoe appliance of claim 4, wherein the pad is integrally formed with the footwear as a unitary piece.

6. The orthopedic shoe appliance of claim 1, wherein different areas of the pad have different heights and/or durometers.

7. A method for improving foot stability, comprising:

providing the orthopedic appliance according to claim 1; and disposing the orthopedic appliance on an insole, midsole, outsole, sock, or footwear.

8. The orthopedic shoe appliance of claim 1, wherein the pad is configured to apply an upward force on proximal ends of the second metatarsal and the third metatarsal and on the lateral longitudinal arch and medial longitudinal arch of the midfoot arches, which cantilevers the first metatarsal, the fourth metatarsal, and the fifth metatarsal in a downward direction.

9. The orthopedic shoe appliance of claim 1, wherein the pad is configured to extend to metatarsal necks, proximate to metatarsal heads, of the second and third metatarsals.

10. A method for manufacturing an orthopedic appliance, comprising:

obtaining a pad;

shaping the pad to have a first portion to provide support for midfoot arches, and a second elongate extension portion to provide support for the second metatarsal, and the third metatarsal of a foot, the elongate extension extending from a region corresponding to proximal ends of the second and third metatarsals to support the second and third metatarsals, but to not provide substantial support under a heel of the foot or under proximal ends of any of the first metatarsal, the fourth metatarsal, and the fifth metatarsal;

shaping the pad such that the first portion comprises a medial raised contour configured to be disposed under a medial arch and a lateral raised contour configured to be disposed under a lateral portion of the foot and the cuboid; and shaping the pad such that a width of the second elongate extension is less than a width of the first portion, the distal end is narrower than a proximal end of the orthopedic shoe appliance, and the second portion, moving away from the distal end, widens generally continuously to reach the lateral raised contour.

* * * * *